US007029406B2

(12) United States Patent
Kasashima et al.

(10) Patent No.: US 7,029,406 B2
(45) Date of Patent: Apr. 18, 2006

(54) GOLF BALL

(75) Inventors: Atsuki Kasashima, Chichibu (JP); Yasushi Ichikawa, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 10/808,452

(22) Filed: Mar. 25, 2004

(65) Prior Publication Data

US 2004/0192473 A1 Sep. 30, 2004

(30) Foreign Application Priority Data

Mar. 28, 2003 (JP) ..... 2003-090959

(51) Int. Cl.
*A63B 37/12* (2006.01)

(52) U.S. Cl. ..... 473/378

(58) Field of Classification Search ..... 473/376, 473/378–385

See application file for complete search history.

(56) References Cited

U.S. PATENT DOCUMENTS 4,431,193 A * 2/1984 Nesbitt ..... 473/374
5,702,311 A * 12/1997 Higuchi et al. ..... 473/373
6,346,053 B1 * 2/2002 Inoue et al. ..... 473/378

FOREIGN PATENT DOCUMENTS

GB 2 243 555 A 11/1991
JP 9-122272 A 5/1997

* cited by examiner

*Primary Examiner*—Raeann Gorden
(74) *Attorney, Agent, or Firm*—Sughrue Mion, PLLC

(57) ABSTRACT

In a golf ball comprising an elastic core, an intermediate layer of at least one layer, and a cover which is provided on its surface with a plurality of dimples, wherein the cover has a gage of 1.0–1.5 mm, the intermediate layer has a gage of 1.0–2.0 mm per layer, the golf ball in its entirety has a specific gravity of 1.128–1.145 g/cm$^3$. On account of an optimum specific gravity in a relatively high range, the ball is improved in flight performance.

8 Claims, 7 Drawing Sheets

GOLF BALL

BACKGROUND OF THE INVENTION

1. Technical Field

This invention relates to a golf ball having improved flight performance.

2. Background Art

As is well known in the art, in order to improve the flight performance of a golf ball, that is, in order for a golf ball to travel a distance when launched, the rebound properties of the ball itself dependent on materials used therein and the sophisticated arrangement of dimples on the ball surface to reduce the air resistance of the ball in flight are important. With respect to the dimples, from the standpoint of distributing dimples as uniformly and densely as possible, there have been proposed from the past a number of design solutions to dimple shape, dimple arrangement, dimple volume relative to ball volume and the like. See JP-A 9-122272, for example. With respect to the radial cross-sectional shape of dimples, a number of designs have been proposed including an arcuate shape, a combination of two arcuate shapes, and a pan bottom shape.

As to the golf ball standards, the ball must have a diameter of not less than 42.67 mm and a weight of not greater than 45.93 grams according to the Rules of Golf (USGA). It is thus a common practice for golf ball manufacturers to manufacture golf balls by designing a model having a slightly larger diameter, hence a slightly larger volume and a slightly lower weight to insure some allowances for the prescribed values, so that the balls are not outside the standards.

Under the circumstances, active studies have been made on the materials used, dimple shape, dimple arrangement, dimple volume relative to ball volume and the like, with the target of improving golf ball flight performance. Nevertheless, no concern about the specific gravity of the ball in entirety has arisen from the standpoint of improving golf ball flight performance.

SUMMARY OF THE INVENTION

An object of the invention is to provide a golf ball having improved flight performance.

Paying attention to the specific gravity of a golf ball comprising an elastic core, an intermediate layer and a dimpled cover, the inventors have discovered that the ball is improved in flight performance when the cover has a specific gage, the intermediate layer has a specific gage, and the ball in its entirety has a specific gravity in a limited range. The resulting golf ball is in accord with the golf ball standards mentioned above.

Accordingly, the present invention provides a golf ball comprising an elastic core, an intermediate layer of at least one layer enclosing the elastic core, and a cover which is provided on its surface with a plurality of dimples. The cover has a gage of 1.0 to 1.5 mm, and the intermediate layer has a gage of 1.0 to 2.0 mm per layer. The golf ball in its entirety has a specific gravity of at least 1.128 g/cm$^3$, and preferably up to 1.145 g/cm$^3$.

A phantom sphere is given on the assumption that the cover surface is free of dimples. Then the total of the volumes of dimple spaces each delimited by a concave wall of a dimple and the surface of the phantom sphere is preferably 1.1 to 1.6% of the volume of the phantom sphere.

The golf ball in flight has a coefficient of lift CL and a coefficient of drag CD. The ratio CL/CD is preferably 0.676 to 0.796 under a set of conditions: Reynolds number 200,000 and spin rate 2,700 rpm, 0.813 to 0.933 under a set of conditions: Reynolds number 120,000 and spin rate 2,400 rpm, and 0.856 to 0.976 under a set of conditions: Reynolds number 80,000 and spin rate 2,000 rpm.

The cover is typically formed by injection molding.

DESCRIPTION OF THE PREFERRED EMBODIMENTS

Figure 1:
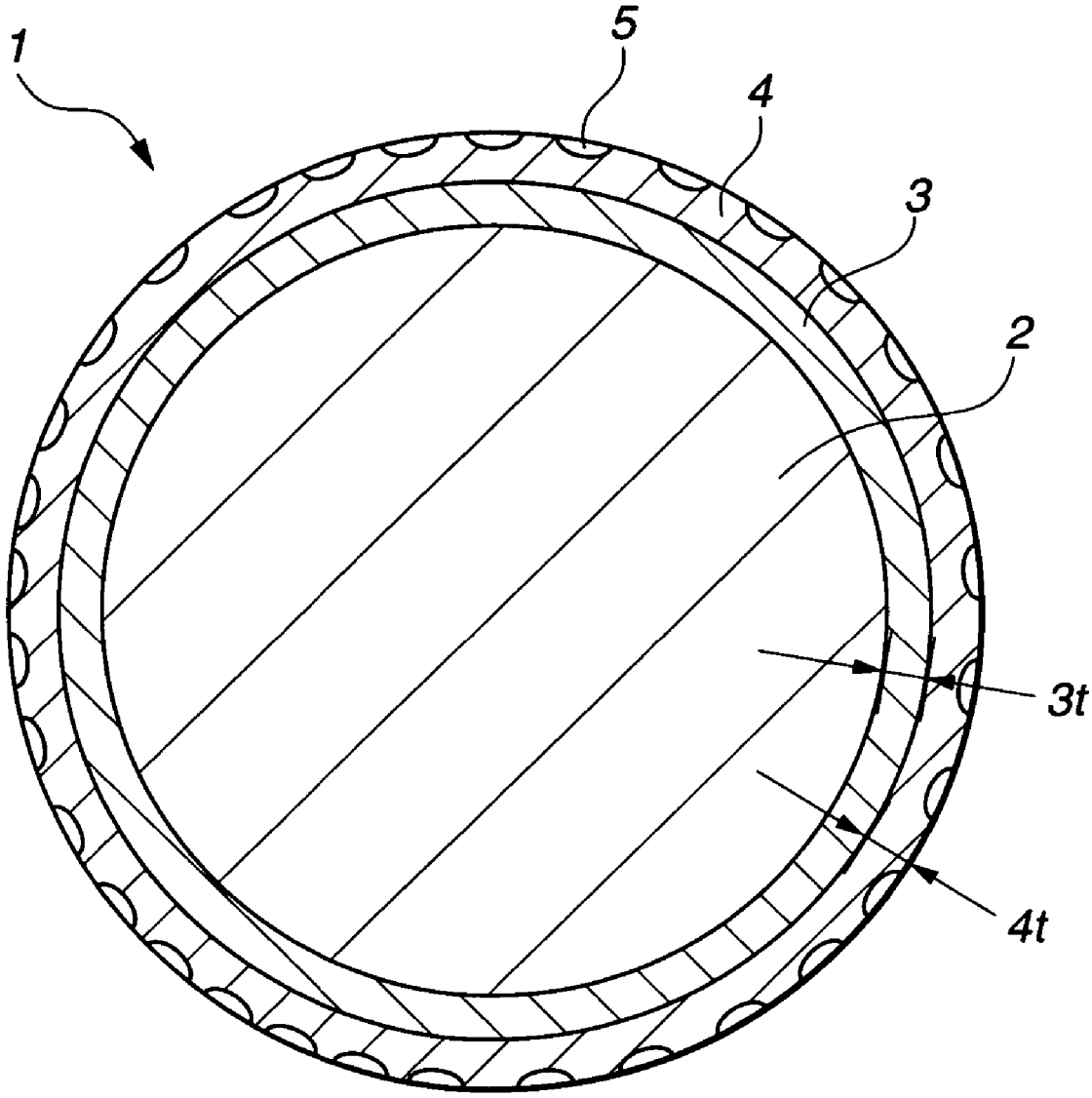
FIG. 1 is a schematic cross-sectional view of a golf ball in one embodiment of the invention.

As used herein, the term "radial" is used with respect to the center of a golf ball unless otherwise stated.

The golf ball of the invention comprises an elastic core, an intermediate layer of at least one layer enclosing the elastic core, and a cover enclosing the intermediate layer in a concentric fashion. The cover is provided on its outer surface with a plurality of dimples and has a gage of 1.0 to 1.5 mm. The intermediate layer of at least one layer disposed between the core and the cover has a gage of 1.0 to 2.0 mm per layer. Provided that the mass of water having the same volume as the ball is 1, the golf ball in its entirety has a specific gravity of at least 1.128 g/cm$^3$.

As used herein, the "specific gravity" of a golf ball refers to, when the ball surface is administered painting, printing and other treatments so that layers of paint and ink are formed on the ball surface, the specific gravity of the entire golf ball including such additional layers.

Provided that the mass of water having the same volume as the golf ball is 1, the specific gravity of the golf ball should be at least 1.128 g/cm$^3$, preferably at least 1.13 g/cm$^3$, and more preferably at least 1.135 g/cm$^3$. If the specific gravity of the golf ball is less than 1.128 g/cm$^3$, the object of the invention to produce a golf ball having an increased travel distance is compromised.

The upper limit of the specific gravity of the golf ball is, though not critical, generally up to 1.145 g/cm$^3$, preferably up to 1.143 g/cm$^3$, and more preferably up to 1.140 g/cm$^3$. If the specific gravity of the golf ball is more than 1.145 g/cm$^3$, the weight of the gold ball would exceed the value prescribed by the Rule, violating the golf ball standards.

The specific gravity of the golf ball can be set within the above-defined range by various methods, for example, by properly selecting materials having a relatively high specific gravity for the respective layers of the elastic core, intermediate layer and dimpled cover, setting appropriate diameters and/or gages to these layers, or incorporating inorganic fillers having a relatively high specific gravity in these layers. Suitable inorganic fillers include, for example, barium sulfate, titanium dioxide, tungsten, and zinc oxide.

In the golf ball of the invention, the gage of the cover designates a normal distance between a spherical surface where the cover is in intimate contact with the intermediate layer and a land surface where no dimples are present on the cover surface. The gage of the cover should be at least 1.0 mm, preferably at least 1.1 mm and up to 1.5 mm, preferably up to 1.4 mm. The range is determined mainly for suppressing the spin that the ball receives when hit with a driver.

The gage of the intermediate layer, per one layer (i.e., one layer in case the intermediate layer is a single layer and each of layers in case the intermediate layer consists of two or more layers), should be at least 1.0 mm, preferably at least 1.2 mm and up to 2.0 mm, preferably up to 1.8 mm. The range is determined mainly for maintaining consistent moldability and minimizing deformation after molding.

Preferably, injection molding is used to form the intermediate layer and cover in order to produce a golf ball having a predetermined weight and outer diameter in a consistent manner.

It is understood that a phantom sphere is assumed when the cover surface is free of dimples and that each dimple having a concave wall has a dimple space delimited by the concave wall and the surface of the phantom sphere. The proportion of the total of the volumes of dimple spaces to the volume of the phantom sphere, sometimes referred to as percent dimple space occupation, hereinafter, is generally preferably at least 1.1%, more preferably at least 1.2%, even more preferably at least 1.25%. The upper limit of percent dimple space occupation is preferably up to 1.6%, more preferably up to 1.55%, even more preferably up to 1.5%. The range is determined mainly for preventing the golf ball, when hit with a driver or a club intended for distance, from skying or inversely, dropping rather than rising, and for adjusting the specific gravity of the golf ball.

Once hit, the golf ball in flight has a coefficient of lift CL and a coefficient of drag CD. The ratio CL/CD should preferably range from 0.676 to 0.796 under a set of conditions: Reynolds number 200,000 and spin rate 2,700 rpm, 0.813 to 0.933 under a set of conditions: Reynolds number 120,000 and spin rate 2,400 rpm, and 0.856 to 0.976 under a set of conditions: Reynolds number 80,000 and spin rate 2,000 rpm.

Referring to FIG. 1, a golf ball 1 in one embodiment of the invention is illustrated in diametrical cross section. The ball includes an elastic core 2 which constitutes a radial central portion of the ball and is enclosed with an intermediate layer 3 and then with a cover 4. The cover 4 is formed on the outer surface with a plurality of dimples 5. The intermediate layer 3 has a gage 3*t* of 1.0 to 2.0 mm, and the cover 4 has a gage 4*t* of 1.0 to 1.5 mm. The dimple 5 is illustrated in an enlarged view of FIG. 2.

Figure 3:
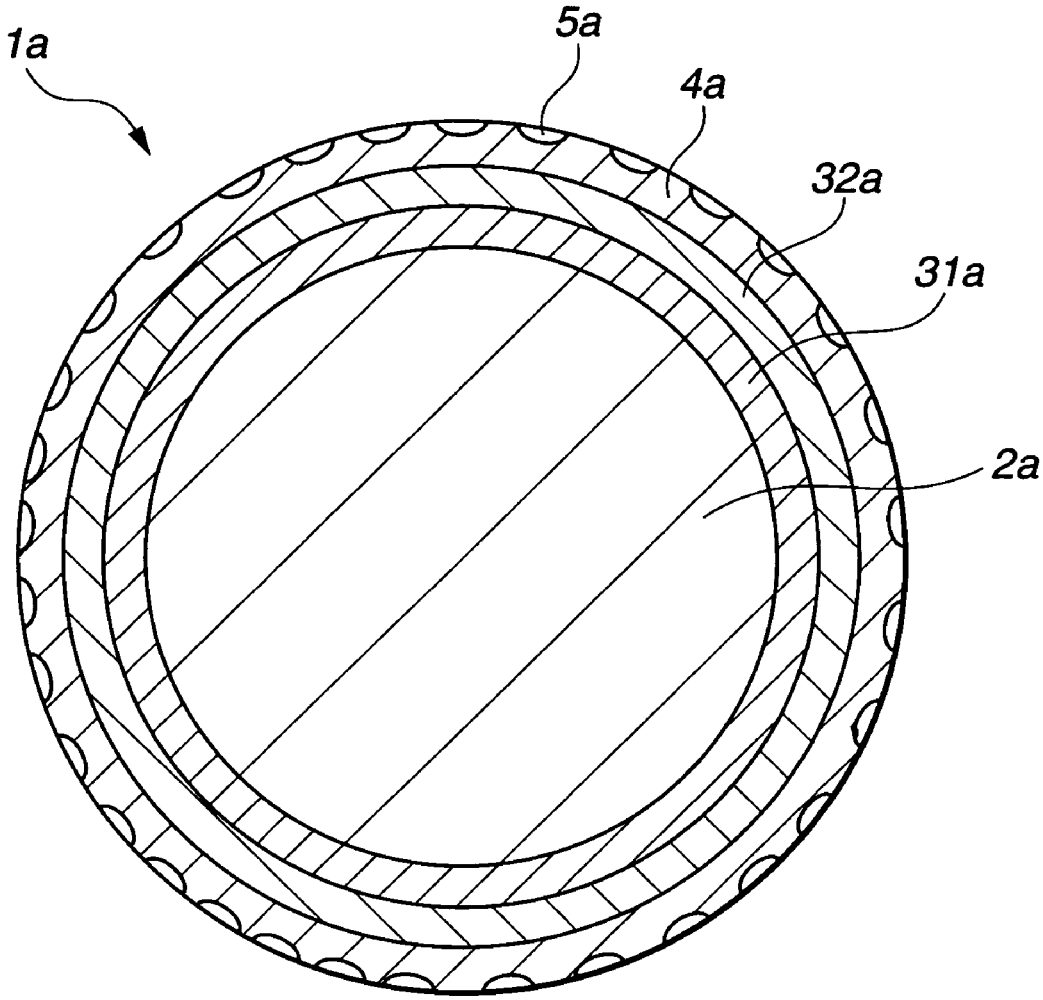
FIG. 3 is a schematic cross-sectional view of a golf ball in another embodiment of the invention.

FIG. 3 is a cross-sectional view of a golf ball 1*a* in another embodiment of the invention. The golf ball 1*a* differs from the golf ball 1 of FIG. 1 in that the intermediate layer consisting of two layers, an inner intermediate layer 31*a* and an outer intermediate layer 32*a* is disposed between the elastic core 2*a* and the dimpled cover 4*a*.

In the inventive golf ball, the elastic core may be formed from any well-known materials for golf ball cores and may be either a thread-wound core or a solid core. The materials for the intermediate layer and cover are not particularly limited, and any materials well known as golf ball materials may be employed. For example, thermoplastic or thermosetting urethane resins may be advantageously used as the cover material, and ionomer resins may be advantageously used as the intermediate layer material.

The Shore D hardness of the intermediate layer, per layer, is not particularly limited and is usually at least 45, preferably at least 50. The upper limit of Shore D hardness is usually up to 70, preferably up to 60. The hardness range is determined from the standpoints of spin rate and resilience.

Also the Shore D hardness of the cover is not particularly limited and is usually at least 45, preferably at least 50. The upper limit of Shore D hardness is usually up to 75, preferably up to 63. The hardness range is determined from the standpoints of spin rate and resilience.

The amount of deflection or deformation (in mm) under load of the elastic core incurred when the load is increased from an initial value of 98 N (10 kgf) to a final value of 1274 N (130 kgf) is not particularly limited and is preferably at least 2.0 mm, more preferably at least 2.5 mm. The upper limit of defection amount is preferably up to 4.5 mm, more preferably up to 4.0 mm. If the deflection amount is less than 2.0 mm, the ball may give a poor feel on impact and travel short due to more spin, especially on long shots with a driver or the like. If the deflection amount is more than 4.5 mm, the ball may give a dull feel on impact, travel short on account of insufficient rebound, and become less durable to cracking upon repeated impact.

In the golf ball of the invention, dimples are distributed on the cover. The shape of dimples, as viewed in plane, is not particularly limited and may be a circular shape which is in favor of the majority, polygonal shape (inclusive of regular polygon) like hexagon and pentagon, elliptic shape, teardrop shape or a combination thereof.

Figure 2:
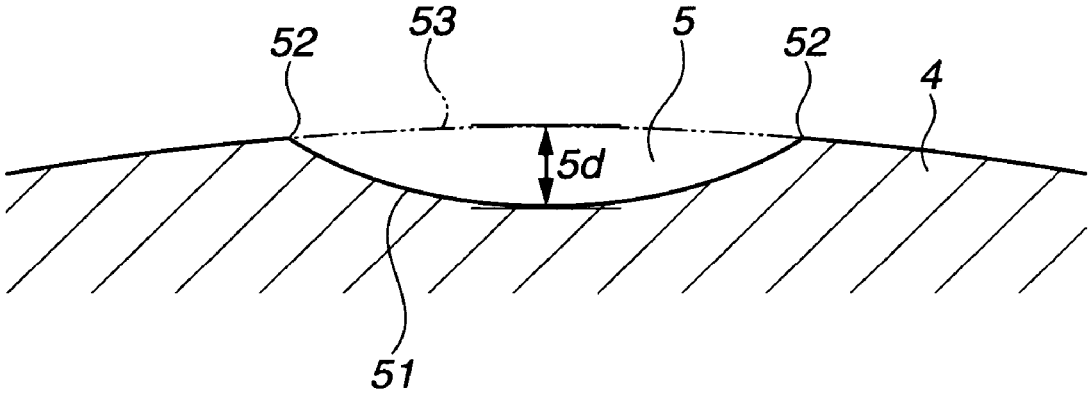
FIG. 2 is an enlarged cross-sectional view of a dimple.

The shape of dimples, as viewed in radial cross section, is not particularly limited. Note that the dimple circumscribed by the land has a concave inner wall 51 and a dimple edge 52 which is a boundary to the land as shown in FIG. 2. In one embodiment, the inner wall 51 of the dimple is arcuate as shown in FIG. 2. In another embodiment, the dimple in radial cross section has a pan bottom shape wherein the wall extends radially inward and sharply from the dimple edge 52 and then merges with a flat bottom. In yet another embodiment, the dimple in radial cross section has a shape that is defined by a sharp side wall extending from the dimple edge (as in the pan bottom shape) and a bottom which is substantially parallel to a circumferential extension 53 from the land (corresponding to the surface of a phantom sphere having a dimple-free cover).

The total number of dimples on the cover, though not particularly limited, is generally at least 250, preferably at least 270 while the upper limit is generally up to 550, preferably up to 500.

The diameter of dimples (in the event dimples are non-circular, the diameter of an equivalent circle having the same area), though not particularly limited, is generally at least 1.5 mm, preferably at least 2.0 mm while the upper limit is generally up to 6.0 mm, preferably up to 5.0 mm. Dimples with a diameter of less than 1.5 mm may exert less of their effect whereas dimples with a diameter of more than 6.0 mm may prevent the ball from rolling.

The depth of dimples is generally at least 0.1 mm, preferably at least 0.15 mm while the upper limit is generally up to 0.5 mm, preferably up to 0.35 mm. Dimples with a depth of less than 0.1 mm may fail to exert their effect whereas dimples with a depth of more than 0.5 mm may incur air resistance. It is understood that the depth of dimples is a radial distance between the surface of a phantom sphere given on the assumption that the cover surface is free of dimples and the deepest bottom of a dimple. This is clearly seen from FIG. 2 in which a dimple depth 5*d* is illustrated as a maximum radial distance between a circumferential extension 53 from the land surface and a dimple inner wall surface 51.

With respect to the number of types of dimples distributed on the cover surface, it is preferred to use dimples of at least two types, preferably at least three types, which are different in diameter and/or depth. The upper limit is up to eight types, preferably up to six types.

Once hit, the golf ball in flight has a coefficient of lift CL and a coefficient of drag CD. The inventive golf ball should preferably have a ratio CL/CD in the range of 0.676 to 0.796 under a set of conditions: Reynolds number 200,000 and spin rate 2,700 rpm (usually encountered immediately after launching); in the range of 0.813 to 0.933 under a set of conditions: Reynolds number 120,000 and spin rate 2,400 rpm (usually encountered at the top of ball trajectory determined visually by an observer on the ground); and in the range of 0.856 to 0.976 under a set of conditions: Reynolds number 80,000 and spin rate 2,000 rpm (usually encountered at an approximately intermediate point between the top of ball trajectory and the landing point, i.e., a point for an approximately lowest velocity of the ball).

In order that the golf ball provide a long carry, good resistance to wind, and a long run when hit with wood club #1 (driver) or a club intended for longer distance, the golf ball must have a good balance between the lift and the drag of the ball in flight, which depend on the specific gravity of the ball as well as the types (inclusive of shape and arrangement), total number, surface occupation, total volume and the like of dimples distributed on the cover surface.

Figure 4:
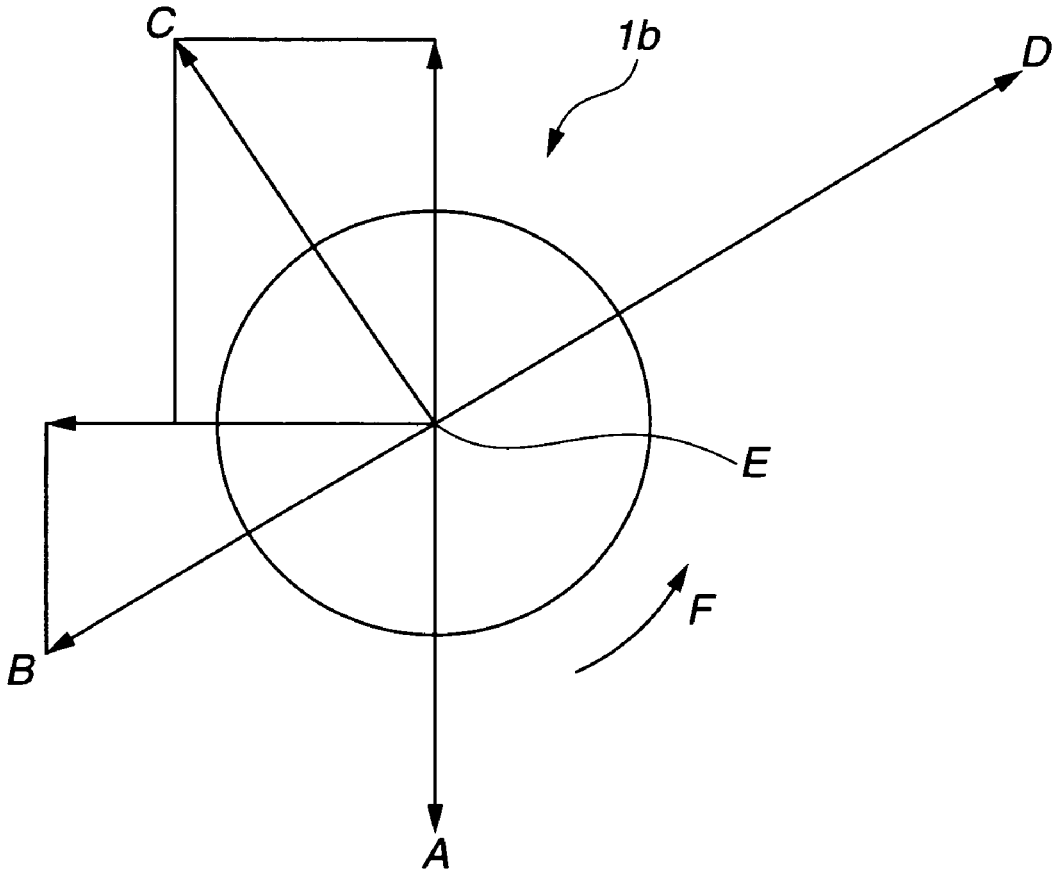
FIG. 4 schematically illustrates various forces acting on a golf ball in flight.

It is known that when the golf ball is hit with a club, gravity A, a drag B caused by air and a lift C due to Magnus effect arising from the ball's spin act on the golf ball 1*b* in flight as shown in FIG. 4. In FIG. 4, D designates a flight direction, and the ball 1*b* spins about its center E in a direction F.

The force acting on the golf ball is represented by the trajectory equation (1):

$$F=FL+FD+Mg \quad (1)$$

wherein F is the force acting on the golf ball, FL is a lift, FD is a drag, and Mg is gravity.

The lift FL and drag FD in trajectory equation (1) are represented by the following equations (2) and (3), respectively:

$$FL=0.5\times CL\times\rho\times A\times V^2 \quad (2)$$

$$FD=0.5\times CD\times\rho\times A\times V^2 \quad (3)$$

wherein CL is a coefficient of lift, CD is a coefficient of drag, ρ is an air density, A is the largest cross-sectional area of the golf ball, and V is a velocity of the ball relative to air.

It has been empirically confirmed that better results are obtained when the gages of the intermediate layer and the dimpled cover are set as defined herein, the specific gravity of the entire ball is set as large as 1.128 g/cm$^3$ or greater, and CL/CD is set in the above-defined range.

There has been described a golf ball which in entirety has an optimum specific gravity in a relatively high range and is thus improved in flight performance.

EXAMPLE

Examples of the invention are given below by way of illustration and not by way of limitation.

Examples 1-3 & Comparative Examples 1-2

A core composition was obtained by combining 100 parts by weight of polybutadiene (trade name BR01 by JSR Corp.), 25 parts by weight of zinc acrylate, 0.8 part by weight of dicumyl peroxide (trade name Percumyl by NOF Corp.), 0.8 part by weight of 1, 1-bis(t-butylperoxy)-3, 3, 5-trimethylsiloxane (trade name Perhexa 3M-40, NOF Corp.), 0.2 part by weight of an antioxidant (trade name Nocrac NS-6, Ouchi Shinko Chemical Industry Co. Ltd.), 25 parts by weight of zinc oxide, 0.5 part by weight of the zinc salt of pentachlorothiophenol, and 5 parts by weight of zinc stearate. It was molded and vulcanized in a core mold at a vulcanizing temperature of 160° C. for 20 minutes, forming solid cores to be used in Examples and Comparative Examples.

In a mold in which the solid core was held, an intermediate layer (one or two layers) was injection molded. Next, in a mold which had a negative dimple pattern and in which the core enclosed with the intermediate layer was held, a cover was injection molded. In this way, three- and four-piece solid golf balls were manufactured. The surface hardness (Shore D hardness) and gage of each layer are shown in Table 1. Various properties of the balls are also shown in Table 1.

Figure 5:
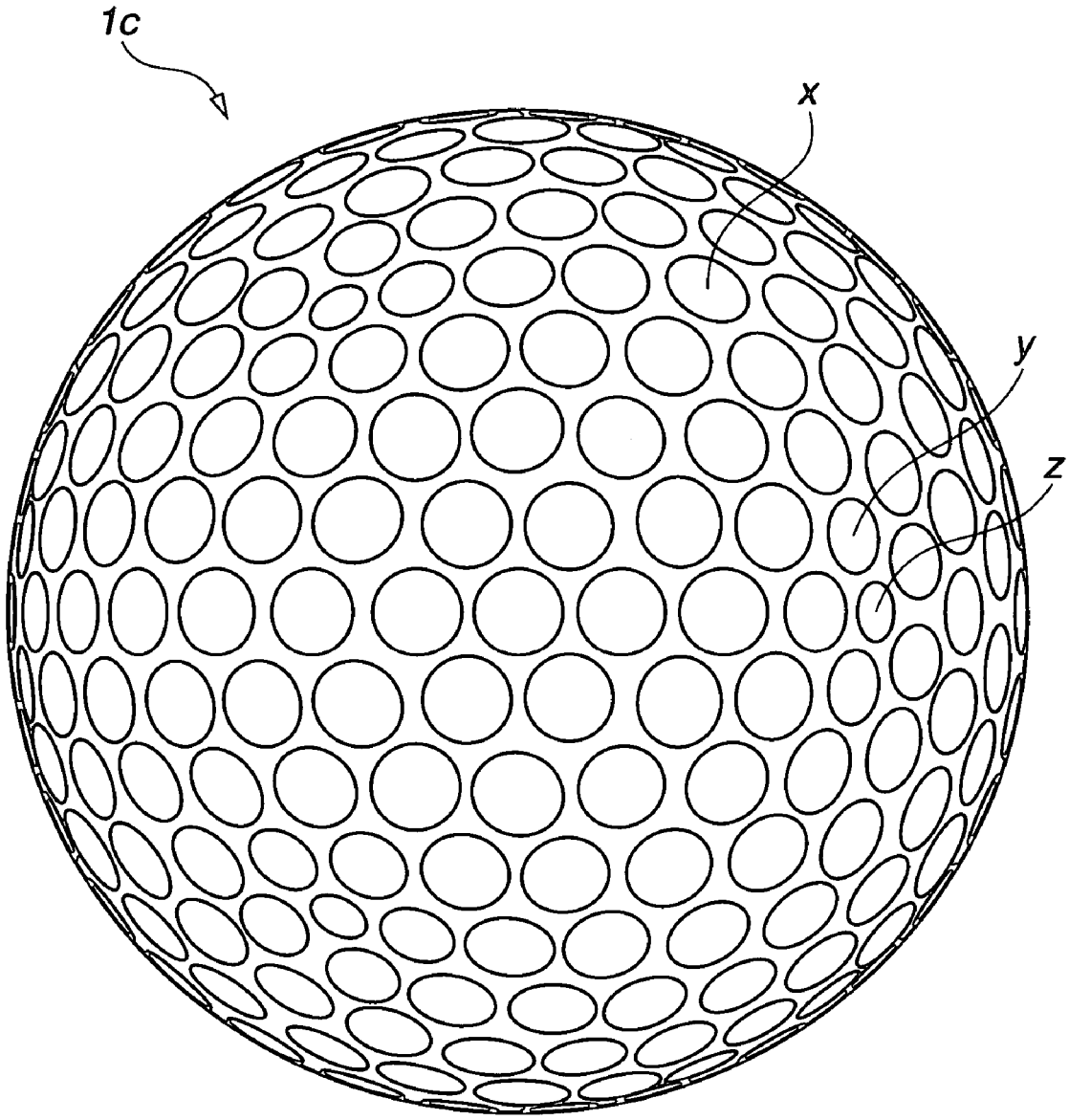
FIG. 5 illustrates one exemplary arrangement of dimples on the cover.
Figure 6:
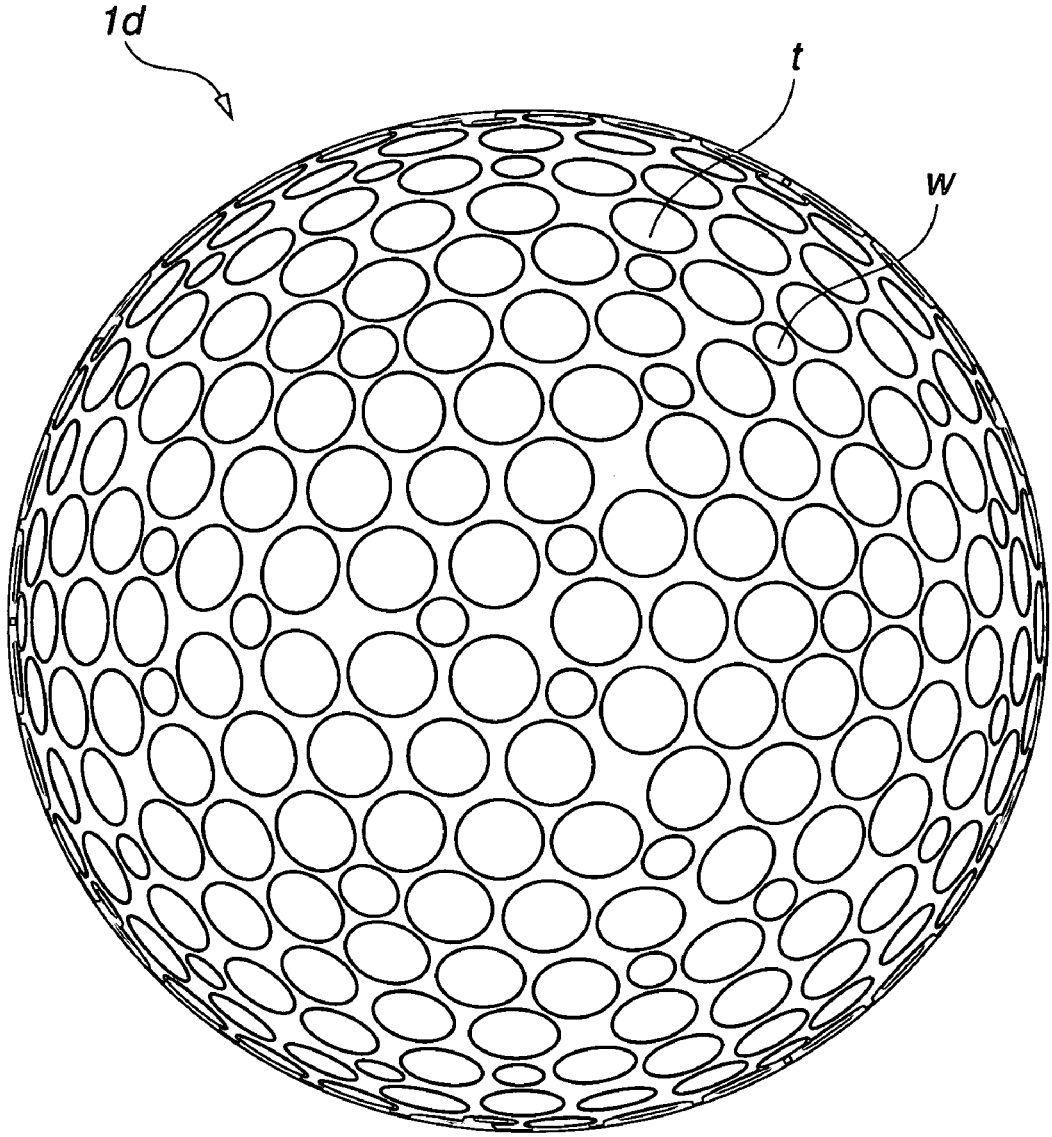
FIG. 6 illustrates another exemplary arrangement of dimples on the cover.
Figure 7:
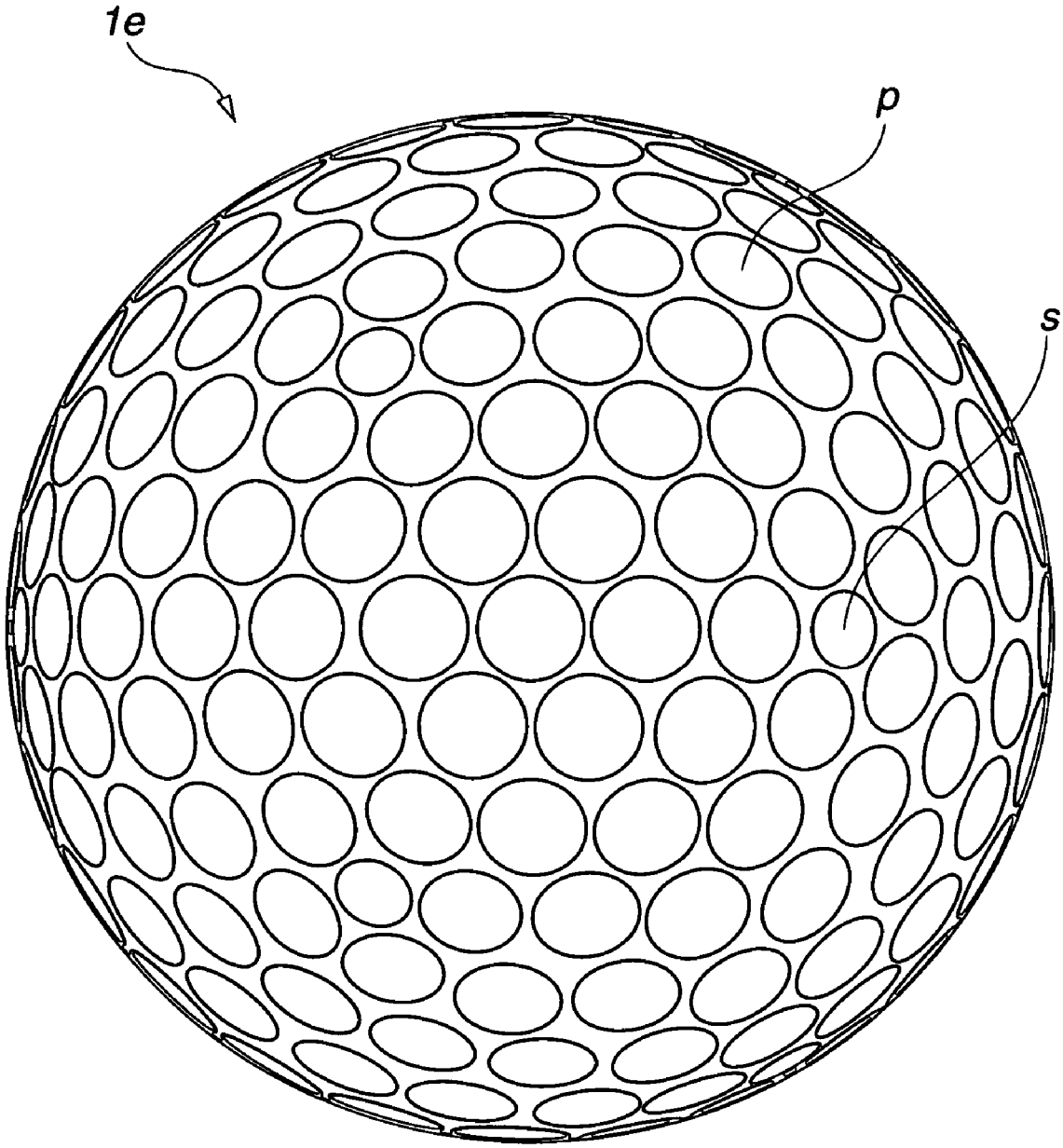
FIG. 7 illustrates yet another exemplary arrangement of dimples on the cover.

Table 2 shows the specifications of dimples while FIGS. 5 to 7 illustrate various arrangement patterns of dimples.

The golf balls were tested for measuring a flight distance. In the test, a hitting machine was equipped with a driver (W#1) and adjusted so that the ball was launched at an initial velocity of 72 m/s and an angle of 10°.

TABLE 1

| | | Example | | | Comparative Example | |
|---|---|---|---|---|---|---|
| | | 1 | 2 | 3 | 1 | 2 |
| Core hardness (mm) | | 3.5 | 3.1 | 3.1 | 3.5 | 3.5 |
| Inner intermediate layer | Material | polyester elastomer | | | | |
| | Gage (mm) | 1.2 | | | | |
| | Hardness (Shore D) | 52 | | | | |
| Outer intermediate layer | Material | ionomer resin | | | | |
| | Gage (mm) | 1.5 | 1.6 | 1.4 | 1.5 | 2.1 |
| | Hardness (Shore D) | 56 | 58 | 56 | 56 | 56 |
| Cover | Material | thermoplastic polyurethane elastomer | | | | |
| | Gage (mm) | 1.15 | 1.1 | 1.15 | 1.15 | 1.7 |
| | Hardness (Shore D) | 50 | 55 | 50 | 50 | 50 |
| Dimple set | | 1 (FIG. 7) | 3 (FIG. 5) | 2 (FIG. 6) | 1 (FIG. 7) | 1 (FIG. 7) |
| Ball weight (g) | | 45.7 | 45.8 | 45.8 | 45.2 | 45.3 |
| Ball diameter (mm) | | 42.7 | 42.7 | 42.7 | 42.72 | 42.7 |
| Ball specific gravity (g/cm$^3$) | | 1.136 | 1.138 | 1.14 | 1.122 | 1.126 |

Core Hardness (mm)

An initial load of 10 kgf was applied to a core resting on a rigid plate. The core hardness is an amount of deflection (in mm) of the core incurred when the load was increased from this state to 130 kgf.

Inner Intermediate Layer Material

Hytrel 4701, thermoplastic polyester elastomer by Dupont-Toray Co., Ltd.

Outer Intermediate Layer Material a blend of Himilan 1605 (ionomer resin by Dupont-Mitsui Chemical Co., Ltd.), Dynaron 6100P (block copolymer having olefinic crystalline blocks by JSR Corp.) and behenic acid (NOF Corp.)

Cover Material a blend of Pandex T8295 (thermoplastic polyurethane elastomer by Bayer-DIC Polymer) and Crossnate EM-30 (isocyanate masterbatch by Dainichi Seika Colour & Chemicals Mfg. Co., Ltd.)

Hardness (Shore D)

Shore D hardness measured according to ASTM D-2240

Ball Specific Gravity

Specific gravity was adjusted by blending appropriate amounts of barium sulfate in the respective layers in good balance. The specific gravity (g/cm$^3$) of a ball was measured using an automatic densimeter Model D-S by Toyo Seiki Seisaku-Sho, Ltd.

TABLE 2

| | | Type | Diameter (mm) | Depth (mm) | Number | Total number | Volume ratio (%) |
|---|---|---|---|---|---|---|---|
| Dimple set | 1 (FIG. 7) | p | 4.15 | 0.26 | 284 | 368 | 1.344 |
| | | q | 3.65 | 0.22 | 60 | | |
| | | r | 3.4 | 0.21 | 12 | | |
| | | s | 2.5 | 0.15 | 12 | | |
| | 2 (FIG. 6) | t | 3.9 | 0.25 | 300 | 432 | 1.315 |
| | | u | 3.8 | 0.24 | 60 | | |
| | | v | 2.85 | 0.19 | 12 | | |
| | | w | 2.45 | 0.15 | 60 | | |
| | 3 (FIG. 5) | x | 4.8 | 0.29 | 200 | 272 | 1.471 |
| | | y | 4.1 | 0.24 | 60 | | |
| | | z | 3.1 | 0.19 | 12 | | |

Note that the "depth" of dimples is a radial distance (mm) between the surface of a phantom sphere (given on the assumption that the cover surface is free of dimples) and the deepest bottom of a dimple; and the "volume ratio" is percent dimple space occupation, i.e., the total of the volumes of dimple spaces divided by the volume of the phantom sphere.

TABLE 3

| | | Example | | | Comparative Example | |
|---|---|---|---|---|---|---|
| | | 1 | 2 | 3 | 1 | 2 |
| Distance (m) | Carry | 246 | 243 | 240 | 240 | 233 |
| | Total | 275 | 277 | 272 | 270 | 262 |

It is demonstrated that the golf balls within the scope of the invention exhibit improved flight distance performance.

Japanese Patent Application No. 2003-090959 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A golf ball comprising an elastic core, an intermediate layer of at least one layer formed of at least one ionomer resin enclosing the elastic core, and a cover which is formed of at least one thermoplastic or thermosetting urethane resin and provided on its surface with a plurality of dimples, wherein the cover has a gage of 1.0 to 1.5 mm, and a Shore D hardness of 45 to 63, the intermediate layer has a gage of 1.0 to 2.0 mm per layer and a Shore D hardness of 50 to 70, and which is harder than the hardness of the cover, wherein a phantom sphere is given on the assumption that the cover surface is free of dimples, the total of the volumes of dimple spaces each delimited by a concave wall of a dimple and the surface of the phantom sphere is 1.1 to 1.6% of the volume of the phantom sphere, and the golf ball in its entirety has a specific gravity of at least 1.128 g/cm$^3$.

2. The golf ball of claim 1 wherein the specific gravity of the golf ball is up to 1.145 g/cm$^3$.

3. The golf ball of claim 1 wherein a phantom sphere is given on the assumption that the cover surface is free of dimples, the total of the volumes of dimple spaces each delimited by a concave wall of a dimple and the surface of the phantom sphere is 1.1 to 1.6% of the volume of the phantom sphere.

4. The golf ball of claim 1 wherein the golf ball in flight has a coefficient of lift CL and a coefficient of drag CD, and the ratio CL/CD is 0.676 to 0.796 under a set of conditions: Reynolds number 200,000 and spin rate 2,700 rpm, 0.813 to 0.933 under a set of conditions: Reynolds number 120,000 and spin rate 2,400 rpm, and 0.856 to 0.976 under a set of conditions: Reynolds number 80,000 and spin rate 2,000 rpm.

5. The golf ball of claim 1 wherein the cover is formed by injection molding.

6. The golf ball of claim 1, wherein the specific gravity of the golf ball is in the range of 1.135 g/cm$^3$ to 1.145 g/cm$^3$.

7. The golf ball of claim 1, wherein an amount of deformation (in mm) under a load, of the elastic core incurred when the load is increased from an initial value of 98 N (10 kgf) to a final value of 1274 N (130 kgf), is in the range of 2 mm to 4.5 mm.

8. The golf ball of claim 1, wherein the intermediate layer is composed of an inner layer formed of polyester elastomer and an outer layer formed of at least one ionomer resin.

* * * * *